US005419099A

United States Patent [19]

Mueller et al.

[11] Patent Number: 5,419,099

[45] Date of Patent: May 30, 1995

[54] SERVO-DRIVE CONTAINER CONVEYING SYSTEM

[75] Inventors: Martin J. Mueller, Palm Harbor; Michael A. Weingandt, Dunedin, both of Fla.

[73] Assignee: Osgood Industries, Inc., Oldsmar, Fla.

[21] Appl. No.: 76,009

[22] Filed: Jun. 11, 1993

[51] Int. Cl.[6] ..... B65B 1/04

[52] U.S. Cl. ..... 53/473; 53/55; 53/282; 53/485; 141/160; 141/167; 198/803.15

[58] Field of Search ..... 53/55, 167, 393, 202, 53/471, 473, 485; 198/303.01, 303.14, 303.15; 206/427, 431; 141/160, 167, 242

[56] References Cited

U.S. PATENT DOCUMENTS

| | | | |
|---|---|---|---|
| 1,690,067 | 10/1928 | Weeks . | |
| 2,103,681 | 12/1937 | Klaucke | 198/803.15 |
| 2,105,795 | 1/1938 | Risser | 198/803.15 |
| 3,538,997 | 11/1970 | Christine | 198/803.15 |
| 3,695,486 | 10/1972 | Warner . | |
| 3,744,538 | 7/1973 | Nasica . | |
| 3,805,478 | 4/1974 | Stohlquist et al. | 53/55 |
| 3,943,625 | 1/1976 | Tiernan . | |
| 4,566,591 | 1/1986 | Turtschan | 206/427 |
| 4,809,575 | 3/1989 | Swanson | 53/55 |
| 5,001,886 | 3/1991 | Turtschan | 53/167.14 |
| 5,127,449 | 7/1992 | Mueller . | |
| 5,287,957 | 2/1994 | Iuchi | 198/803.14 |

FOREIGN PATENT DOCUMENTS

| | | | |
|---|---|---|---|
| 0286514 | 3/1988 | European Pat. Off. . | |
| 531103 | 3/1993 | European Pat. Off. | 53/55 |
| 2610904 | 3/1976 | Germany . | |
| 521115 | 11/1938 | United Kingdom . | |

*Primary Examiner*—W. Donald Bray

*Attorney, Agent, or Firm*—Dressler, Goldsmith, Shore & Milnamow, Ltd.

[57] ABSTRACT

An intermittently operated, indexing container conveying system is particularly configured for versatile use with an associated container filling apparatus. In distinction from previous arrangements, the present system includes a servo-drive motor for effecting intermittent indexing movement of a container-carrying endless conveyor. Programmable controls of the system facilitate operation of the system for optimizing efficiency, facilitating use of the system with containers of differing configurations, and with food products exhibiting varying physical properties (i.e., such as viscosities). The present system permits acceleration and deceleration rate of the conveyor to be selectively varied, as well as selective variation of indexing pitch and stop points of the conveyor.

10 Claims, 2 Drawing Sheets

SERVO-DRIVE CONTAINER CONVEYING SYSTEM

TECHNICAL FIELD

The present invention relates generally to arrangements for effecting filling of containers with food products and the like, and more particularly to a servo-drive container conveying system for use with a container filling apparatus, with the servo-drive of the system permitting highly versatile operation, including selective variation of indexing pitch and indexing acceleration and deceleration, thereby facilitating use of the system with different containers and different products.

BACKGROUND OF THE INVENTION

In order to effect filling of containers with food products, such as margarine, ice cream, and the like, specialized equipment has been developed which operates to successively move containers through various stages of a filling and sealing operation. This equipment typically includes an intermittently driven, indexed container conveyor, which operates to convey containers in relation to various filling and sealing stations. In a typical arrangement, containers are dispensed onto individual flights of the conveyor, with the containers thereafter successively presented to a filling station (for filling with product), and subsequent sealing and/or lid-applying stations. Suitable mechanisms eject the filled containers from the conveyor for subsequent packaging, storage, and shipment.

As will be appreciated, operation of this type of container filling equipment requires synchronization and coordination of the various filling and sealing operations with the indexed, intermittent advancement of the containers. Heretofore, conveyors used for container filling have typically included mechanical drive systems which operate, through suitable cams and clutches, to intermittently effect indexed movement of the conveyor flights. By such arrangements, a continuously operated drive motor acts through the cam drives to intermittently advance the associated conveyor, with the cam profile characteristics of the arrangement defining the dwell period, and rates of container acceleration and deceleration, for each cycle of operation during which the conveyor is indexed.

While conveying arrangements of the above type are in widespread use and have proven to be highly reliable and efficient, such arrangements do not lend themselves to versatility in application. In particular, different food products can exhibit a wide variety of different viscosities, and thus the requirements for handling one type of food product can be significantly different than those for another product. For example, relatively low viscosity products cannot be accelerated and decelerated too quickly during conveyor indexing if spillage is to be avoided, while relatively viscous products can be subjected to higher acceleration and deceleration rates. As will be appreciated, adapting the conveyor of a filling machine to handle these differing products typically requires reconfiguring the drive of the apparatus to include cam drives having cam profiles suited for the particular product being conveyed.

Such reconfiguration of the conveyor drives in conventional equipment is typically required if the conveyor pitch, i.e., the distance which the conveyor is indexed during each cycle, is to be altered. Various sizes and types of containers typically require that conveyors be capable of various pitches of indexing movement, with conventional mechanical cam drives ordinarily requiring reconfiguration for providing different pitches of indexing movement.

A further drawback of conventional conveying arrangements relates to use of a single conveyor for conveying more than one type of container. For some applications, it can be desirable for a conveyor to have non-consecutive conveyor flights arranged to carry containers of a first configuration, while other ones of the flight carry containers of a second, differing configuration. In operation, it can be desirable to index the conveyor between the non-consecutive flights carrying containers of the one configuration, without stopping the other flights at the various filling stations. Again, reconfiguration of the mechanical drive is typically required for such an application.

The present invention contemplates a conveying system for use with a filling apparatus which is particularly configured for highly versatile use without resort to time-consuming reconfiguration of a mechanical drive of the system.

SUMMARY OF THE INVENTION

A container conveying system embodying the principles of the present invention is particularly suited for use with a container filling apparatus having at least one, and typically a plurality, of stations which effect filling of containers with a product, as well as closing and sealing of the containers. In distinction from arrangements known heretofore, the present conveying system includes a servo-drive motor which drives an endless conveyor in relation to the stations of the filling apparatus. Instead of use of the typical cam drives and the like, the present system includes controls which intermittently operate the servo-drive motor for effecting indexed movement of the endless conveyor, and containers carried thereby. By this arrangement, rates of acceleration and deceleration, indexing pitches, and positioning of the conveyor relative to the filling stations, can all be selectively and conveniently varied for efficient and versatile operation.

In accordance with the illustrated embodiment, the present conveying system is incorporated into a container filling apparatus, such as the type typically used for successively filling containers with food products. It will be understood that the present container conveyor can be used for other types of filling operations.

The filling apparatus includes at least one, and typically a plurality, of stations with respect to which the endless conveyor is indexed in an intermittent manner. Container filling, container sealing, and lid applying stations are typically provided in a filling apparatus.

The present container conveying system includes a frame positioned in association with, or integrated with, the filling apparatus. An endless conveyor is carried by the frame for movement relative to the one or more stations of the filling apparatus so that containers are successively presented to the various stations. To this end, the container comprises a plurality of interconnected conveyor flights each configured for carrying at least one container for filling. In the illustrated embodiment, the endless conveyor includes a pair of spaced apart conveyor chains between which the conveyor flights extend. Drive sprockets respectively associated with the conveyor chains are driven for effecting movement of the endless conveyor.

In accordance with the present invention, intermittent, indexed movement of the conveyor is effected with a servo-drive motor operatively connected with the conveyor, via the drive sprockets in the illustrated embodiment. In significant distinction from previous arrangements which have included continuously operated motors, the servo-drive motor of the present system is configured for intermittent, programmed operation, thereby facilitating highly versatile conveyor operation. To this end, the present system includes programmable controls, operatively connected to the servo-drive motor, for effecting control of the motor and the endless conveyor. Appropriate programming of the controls permits intermittent, indexing movement of the endless conveyor to be selectively varied for accommodating use with different containers and with different products for filling containers.

Specifically, an important aspect of the present invention is its versatile application for use with different products, particularly those exhibiting differing viscosities. During operation, the controls operate the servo-drive motor for indexing movement of the conveyor, during each cycle of operation, such that different ones of the conveyor flights are positioned in successive association with each of the stations of the filling apparatus for effecting filling (or sealing, lid-applying, or the like) of the containers carried by the conveyor flights.

Appropriate programming of the controls permits the rate of acceleration and deceleration of the conveyor, during each cycle of operation, to be selectively varied to accommodate filling of containers with different products. Thus, the overall output speed of the conveying system can remain constant (i.e., each cycle of indexing movement is for a predetermined time period), but the acceleration and deceleration rate of the conveyor can be selectively varied, depending upon the characteristics of the product with which the containers are being filled. Since higher viscosity products can be accelerated and decelerated more quickly without risk of spillage, programming of the controls to maximize these rates can desirably "create" additional time during the dwell period of intermittent operation by maximizing the dwell period for a given cycle time. This can desirably provide additional time for certain ones of the filling and sealing operations (such as heat-sealing of the containers). As will be appreciated, such selective variation in acceleration and deceleration rates can be made even though the overall output speed of the system remains the same.

Further versatility of the present system is achieved by the programmable nature of the controls for effecting differing degrees of indexing movement, i.e., different pitches of conveyor indexing. This permits the system to be readily adapted for different applications, since the pitch of the system can be easily programmed with the controls, as required. Thus, configuring the system for typical 4.5 inches, 6 inches, or 7.5 inches pitches can all be achieved without resort to use of differing mechanical drive arrangements.

Further versatility is achieved by the manner in which the system can be operated for indexing between non-consecutive ones of the conveyor flights. For some applications, it can be desirable to configure the endless conveyor with non-consecutive flights configured for carrying containers of a first configuration, with other ones of the flights being configured for carrying containers of a second, differing configuration. This may be the case if the same filling apparatus and conveying system are to be used for filling two different types or sizes of containers. Again, the programmable controls of the system provide versatile operation, permitting intermittent, indexed advancement of the conveyor between non-consecutively arranged ones of the flights, without stopping the other flights at the various filling stations.

Other features and advantages of the present invention will become readily apparent from the following detailed description, the accompanying drawings, and the appended claims.

DETAILED DESCRIPTION

Figure 1:
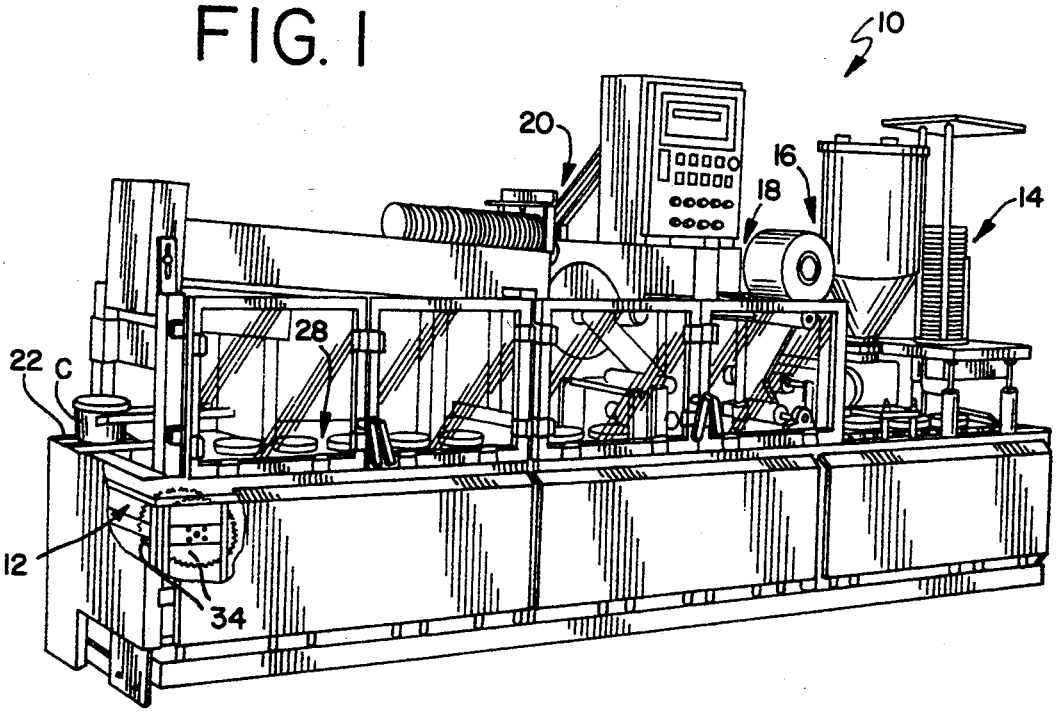
FIG. 1 is a perspective view of a container filling apparatus including a container conveying system embodying the principles of the present invention.

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

With reference now to FIG. 1, therein is illustrated a container filling apparatus 10, including a container conveying system 12 embodying the principles of the present invention. In the illustrated embodiment, the container conveying system 12 is integrated into the container filling apparatus, but it will be appreciated that the present system can be otherwise configured, such as separate from, but positionable in association with, suitable container filling equipment.

In accordance with typical machines of this nature, container filling apparatus 10 includes a plurality of stations with respect to which the conveying system 12 intermittently advances containers by indexed movement of the conveying system. To this end, the apparatus includes a container dispensing station 14, which dispenses containers for carrying by the conveying system. The containers are thereafter sequentially and successively presented to a filling station 16, for filling with product. In the illustrated embodiment, the filling apparatus further includes a sealing station 18, which is employed for some applications to place a foil or plastic seal across the mouth of the filled container (such as by heat-sealing), with containers thereafter presented to a lid-applying station 20 of the filling apparatus 10. After the containers have been filled, sealed, and closed, they are presented by the conveying system at a chute 22, where the containers are then transferred from the filling apparatus for subsequent packaging, storage, and shipment.

The various devices of the filling apparatus will be well-known by those familiar with the art. For example, the filling station 16 may include a servo-driven fill pump in accordance with commonly-assigned U.S. Pat. No. 5,127,449, hereby incorporated by reference, although other types of filling devices can be employed for use with the present conveying system. Similarly, devices for effecting container sealing, and lid-application can be of known configurations, such as disclosed in U.S. Pat. No. 4,835,943, hereby incorporated by reference.

Figure 2:
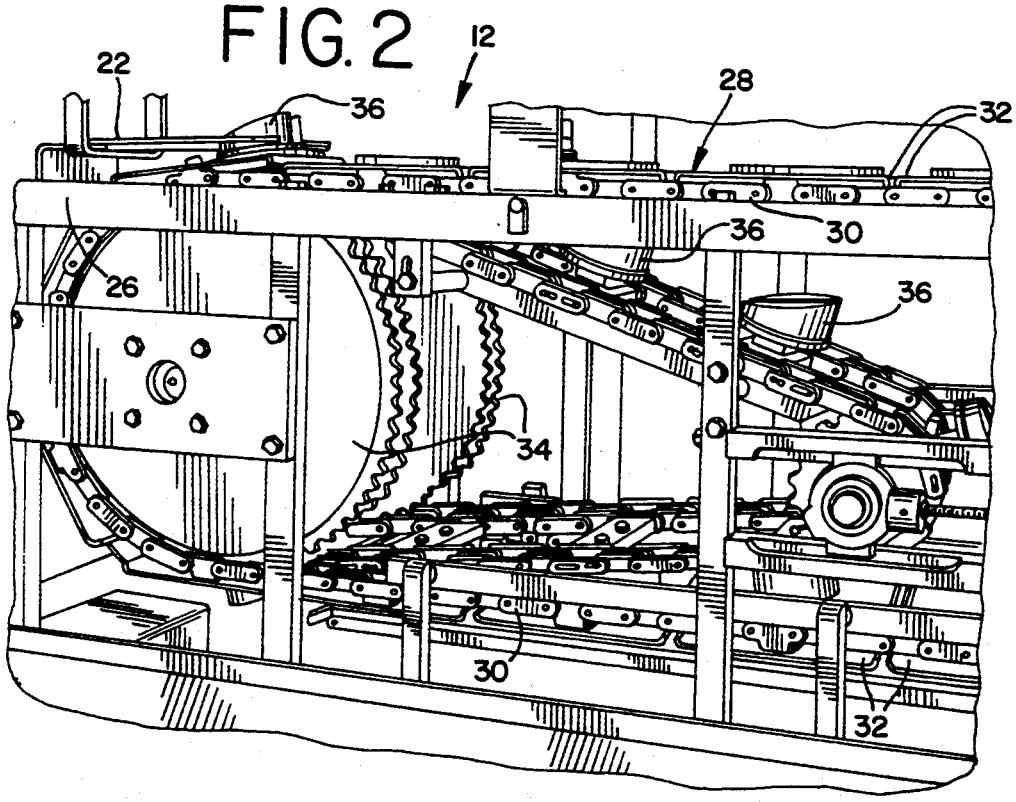
FIG. 2 is a perspective view of the interior of the filling apparatus shown in FIG. 1, illustrating a portion of the present container conveying system.
Figure 3:
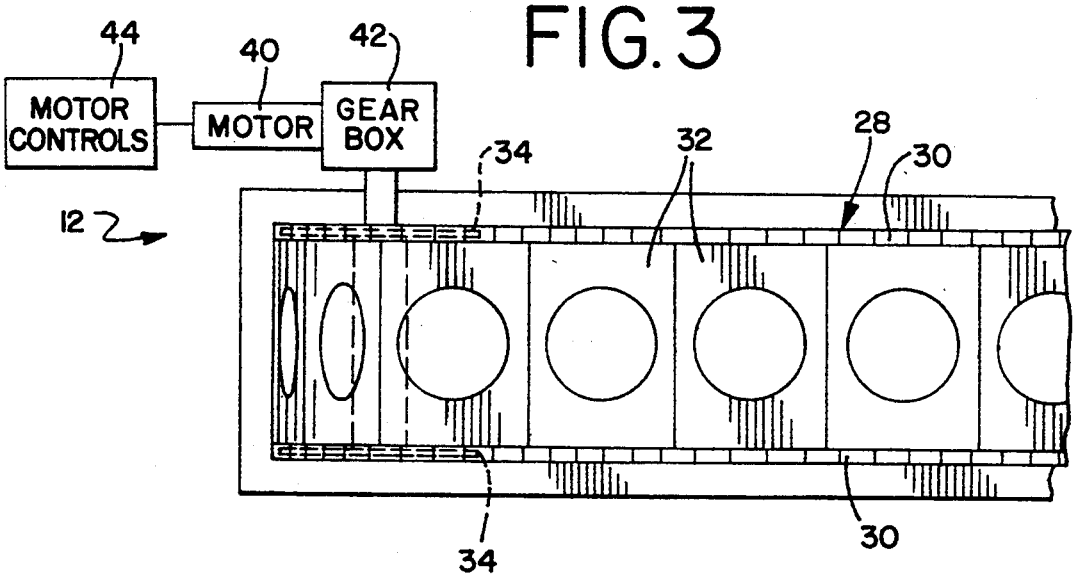
FIG. 3 is a diagrammatic view further illustrating the present container conveying system.

With particular reference to FIGS. 2 and 3, the container conveying system 12 of the present invention will now be described. The conveying system includes a frame 26, which may be integral or common with the frame of the filling apparatus, with the system further including an endless conveyor 28 carried by the frame for movement relative to the stations of the filling apparatus. The endless conveyor includes a pair of spaced apart conveyor chains 30 between which extend a plurality of interconnected conveyor flights 32 arranged successively along the length of the endless conveyor chains. As illustrated, each conveyor flight 32 is configured for carrying at least one container C as the conveyor is intermittently driven and indexed such that the containers are sequentially and successively presented to the various stations of the filling apparatus.

Drive of the endless conveyor 28 is effected via drive sprockets 34 respectively associated with the drive chains 30. As illustrated in FIG. 2, an additional, inner pair of sprockets, driven with sprockets 34, effect driven movement of chain-mounted container pushers 36, which act to push containers from within the conveyor flights 32 so that the filled containers are received on chute 22 for transfer out of the filling apparatus.

With reference to FIG. 3, the drive arrangement of the present conveying system is diagrammatically illustrated. Significantly, the drive arrangement includes a servo-drive motor 40 such as the type available from Camco/Emerson Electric Co., of Wheeling, Ill., which operates through the gear box 42, which in turn is operatively connected with drive sprockets 34 (via a drive shaft) for effecting driven, intermittent movement of endless conveyor 28. This type of servo-drive motor is configured for precise, variable speed operation, control of which is effected by motor controls 44 of the present system.

Motor controls 44 can be of a known, programmable type to facilitate the desired operation of the endless conveyor 28. As will be appreciated, use of program controls, in conjunction with servo-drive motor 40, provide a number of distinct advantages over conventional, mechanically-driven container conveyors (including cam drives and the like).

One particularly desirable aspect of the present system is its programmability for selectively varying acceleration and deceleration rates of endless conveyor 28, thus permitting optimized efficiency in operation of the filling apparatus. Specifically, it will be appreciated that different types of food products and the like exhibit differing characteristics (such as viscosity) which can affect the manner in which such products must be conveyed. While rates of acceleration and deceleration for relatively low viscosity products must be appropriately low to avoid spillage, high viscosity products can be accelerated and decelerated at relatively greater rates.

Thus, the programmability of controls 44 for operation of servo-drive motor 40 permits the conveying system to be operated for optimum efficiency, by tailoring the acceleration and deceleration rates to the maximum values permissible for the particular product being conveyed. Notably, for a given output rate of the present conveying system, this programmability of acceleration and deceleration rates desirably permits the dwell period of each cycle to be maximized, for a given cycle time. The extra dwell time thus "created", by reducing the period of indexing movement, can be desirable for more effectively performing certain ones of the operations at the various stations of the filling apparatus (i.e., such as providing more time for effecting heat-sealing of the containers at sealing station 20).

Use of the programmable controls 44 in conjunction with servo-drive motor 40 also permits desirable versatility in adjustment of the "stop points" of the conveyor 28. As will be appreciated, certain ones, or all of, conveyor flights 32 are sequentially and successively presented to each of the various stations of filling apparatus 10 for container filling and closing. As such, the flights are each positioned in a predetermined position relative to each station for effecting the desired operation thereat. Controls 44, operating the servo-drive motor 40, permit selective variation of this predetermined positioning, by adjustment of the "stop points" of the conveyor, thus facilitating the filling operation. Again, this can all be achieved through the controls 44, without resort to any adjustment of the mechanical components of the drive system, or the like.

Further advantages of the present system are derived by its programmability for variability of indexing pitch, i.e., distance of indexing movement, of the endless conveyor 28. Depending upon the configuration of the flights 32, it is ordinarily desirable that the conveyor be indexed at any of a variety of predetermined pitches (such as 4.5 inches, 6 inches, 7.5 inches, etc.). Heretofore, replacement of mechanical components of a conveyor drive has been necessary for effecting such adjustment of pitch. In contrast, the present system, through use of programmable controls 44, permits this variation in pitch to be easily programmed into the system, without resort to any mechanical reconfiguration of the conveyor drive.

Figure 4:
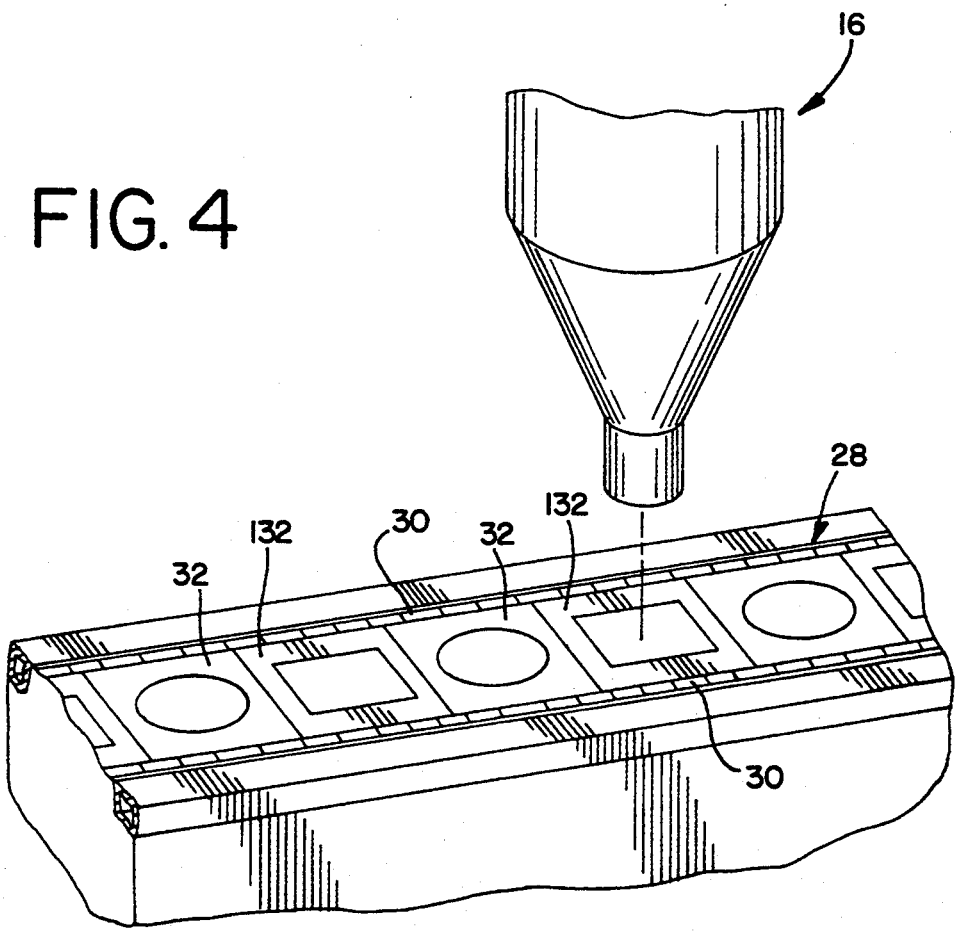
FIG. 4 is a diagrammatic view illustrating the manner in which the present container conveying system can be configured for use with differently configured containers.

This versatility is exhibited in a similar manner when the conveyor 28 is operated to index non-consecutively arranged ones of the conveyor flights. FIG. 4 diagrammatically illustrates an arrangement wherein non-consecutive ones of the flights of the conveyor 28, designated 32, are configured for carrying containers of a first configuration. In contrast, other ones of the flights designated 132, arranged in alternating relationship with the flights 32, are configured for carrying containers having a second configuration, differing from the first configuration. A conveyor configured in this manner is sometimes employed in a filling operation where it is necessary to fill two different types of containers, but where capacity does not require the use of two separate filling machines and conveying systems. For such an application, the servo-drive motor 40 is controlled to intermittently drive the endless conveyor such that the non-consecutively ones of the conveyor flights, which are configured for carrying similar containers, are presented to the stations of the filling apparatus, while the conveyor is indexed through or past the intervening ones of the flights.

While the benefits derived by the present programmable conveying system are principally derived during intermittent operation thereof for indexed movement of containers, the system offers further versatility in connection with cleaning or other maintenance of the system and associated filling apparatus, in that the controls 44 can readily be programmed to continuously operate the servo-drive motor 40, i.e., non-intermittently without indexing movement. As will be recognized, this offers further distinct advantages over conventional equipment, wherein continuous motor operation results in intermittent conveyor movement.

From the foregoing, it will be observed that numerous modifications and variations can be effected without departing from the true spirit and scope of the novel concept of the present invention. It is to be understood that no limitation with respect to the specific embodiment illustrated herein is intended or should be inferred. The disclosure is intended to cover, by the appended claims, all such modifications as fall within the scope of the claims.

What is claimed is:

1. A container conveying system for use with a container filling apparatus having at least one station for effecting filling of containers with product, said conveying system comprising:

frame means;

an endless conveyor carried by said frame means for movement relative to said station of said filling apparatus, said conveyor comprising a plurality of interconnected conveyor flights each configured for carrying at least one container for filling;

servo-drive motor means operatively connected to said endless conveyor for effecting intermittent driven movement of said conveyor; and control means operatively connected to said servo-drive means for effecting control of said motor means and said endless conveyor, said control means permitting intermittent indexing movement of said endless conveyor to be selectively varied, said control means operate said servo-drive motor means for indexing movement of said endless conveyor, during a cycle of operation, such that different ones of said conveyor flights are positioned in successive association with said station of said filling apparatus, during a dwell period in each cycle of operation, for effecting filling of containers carried by said flights, said control means permitting the rates of acceleration and deceleration of said conveyor, during a cycle of operation, to be selectively varied to maximize the dwell period of each cycle for a given cycle time to accommodate filling of containers with different products.

2. A conveying system in accordance with claim 1, wherein said control means operate said servo drive motor means for indexing movement of said endless conveyor such that pitch of indexing movement can be selectively varied to accommodate use of said system with different containers.

3. A conveying system in accordance with claim 1, wherein said endless conveyor includes non-consecutively arranged ones of said conveyor flights configured for carrying containers having a first configuration, with other ones of said flights configured for carrying containers having a second configuration different than said first configuration, said control means operating said servo-drive motor means to intermittently drive and index said conveyor, relative to said station, between said non-consecutively arranged ones of said conveyor flights.

4. A conveying system in accordance with claim 1, wherein said control means operate said servo-drive motor means to index said conveyor to position selected ones of said conveyor flights in a predetermined position relative to said station of said filling apparatus, said control means permitting said predetermined position to be selectively varied to facilitate filling of said containers with product.

5. A conveying system in accordance with claim 1, wherein said endless conveyor comprises a pair of spaced apart conveyor chains between which said conveyor flights extend, and drive sprockets respectively associated with said conveyor chains for effecting movement thereof, said servo-motor drive means being operatively connected with said drive sprockets for intermittently driving said conveyor.

6. A method of conveying containers for effecting filling with product by a container filling apparatus having at least one station, comprising the steps of:

providing an endless conveyor for movement relative to said station of said filling apparatus, said conveyor including a plurality of interconnected conveyor flights each configured for carrying at least one container;

driving said endless conveyor with servo-drive motor means for effecting intermittent driven movement of said conveyor; and controlling said servo-drive motor means so that intermittent indexing movement of said endless conveyor can be selectively varied including controlling said servo drive motor means to selectively vary the rates of acceleration and deceleration of said endless conveyor during a cycle of operation during which said conveyor is indexed relative to said station to maximize a dwell period of each cycle for a give cycle time.

7. A method of conveying containers in accordance with claim 6, including controlling said servo-drive motor means to selectively vary the pitch of indexing movement of said conveyor to accommodate conveying different containers.

8. A method of conveying containers in accordance with claim 6, wherein said step of providing said endless conveyor includes configuring non-consecutive ones of said conveyor slights for carrying containers having a first configuration, and configuring other ones of said flights for carrying containers having a second configuration different than said first configuration, and controlling said servo-drive motor means to intermittently drive and index said conveyor, relative to said station, between said non-consecutive ones of said flights.

9. A method of conveying containers in accordance with claim 6, including controlling said servo-drive motor means to position selected ones of said conveyor flights in a predetermined position relative to said station of said filling apparatus, including selectively varying said predetermined position to facilitate filing of said containers with product.

10. A method of conveying containers in accordance with claim 6, including controlling said servo-drive motor means to continuously drive said endless conveyor without indexing movement to facilitate cleaning.

* * * * *